United States Patent [19]

Hetke et al.

[11] 4,040,821

[45] Aug. 9, 1977

[54] NODULARIZING CATALYST FOR CAST IRON AND METHOD OF MAKING SAME

[75] Inventors: Adolf Hetke, Livonia; Prem P. Mohla, Plymouth; Robert J. Warrick, Ann Arbor, all of Mich.

[73] Assignee: Ford Motor Company, Dearborn, Mich.

[21] Appl. No.: 711,680

[22] Filed: Aug. 4, 1976

Related U.S. Application Data

[62] Division of Ser. No. 606,908, Aug. 22, 1975.

[51] Int. Cl.[2] ..... C22C 33/08; C22C 28/00

[52] U.S. Cl. ..... 75/134 S; 75/130 A; 75/130 R

[58] Field of Search ..... 75/130 R, 134 S, 130 A

[56] References Cited

U.S. PATENT DOCUMENTS

| | | | |
|---|---|---|---|
| 3,383,202 | 5/1968 | Lynch | 75/134 S |
| 3,717,456 | 2/1973 | Percheron | 75/134 S |

*Primary Examiner*—Peter D. Rosenberg

*Attorney, Agent, or Firm*—Joseph W. Malleck; Keith L. Zerschling

[57] ABSTRACT

An improved catalyst is disclosed for making spheroidal graphite cast iron, the catalyst being in the form of a solid impervious and brittle block but severed from a sheet stock having a predetermined grid pattern of perforations or notches along at least one surface of said sheet stock. The block is substantially devoid of segregation and oxide interiorally thereof; the thickness of said block is increased over that capable of being produced by the prior art in the as-cast condition and yet devoid of segregation. The method of making such block comprises casting the molten catalyst into shallow closed pans, the cover for said pans carrying a pattern of ribs or projections, the cover and pan cooperating to define a selected configuration for an as-cast sheet stock. The resulting cast product can be manually or automatically broken along any desired module, defined by said grid pattern, to suit a variety of in plant casting applications particularly utilizing in-the-mold nodularizing treatment. The latter method places a nodularizing catalyst in a recess or reaction chamber defined within the gating system of a mold, whether constructed of bonded sand or pre-cast refractory.

4 Claims, 4 Drawing Figures

NODULARIZING CATALYST FOR CAST IRON AND METHOD OF MAKING SAME

This is a division of application Ser. No. 606,908, filed Aug. 22, 1975.

BACKGROUND OF THE INVENTION

The ability to nodularize cast iron was significantly advanced some 27 years ago when it became known that magnesium, rare earth metals, calcium or their alloys (hereinafter referred to as the alloy), will reliably condition a molten iron charged to form nodular graphite upon solidification. Since that time, the art has moved progressively from (a) adding the alloy to the molten iron charge in the ladle by such methods as plunging, immersion or the sandwich technique to (b) adding the alloy to the molten charge in a stream immediately before entering the mold, and finally to (c) adding the alloy into a portion of the gating system within the mold.

The earliest use of adding the alloy to a portion of the gating system in the mold was developed particularly with respect to inoculation, a form of cast iron and nodular iron conditioning which not only heralded the way but proved that total nodularization can be carried out within the mold. All of the in-the-mold techniques have possessed one common characteristic, namely: the alloy has been introduced in a particulate or powdered form or a compact made of these. The particulate alloy was (1) introduced in measured scoops spilled into a reaction chamber defined in a sand mold or (2) the alloy was premolded in particulate form within a foam suspension defining the gating system, or (3) a precompacted or extruded shape of particulate magnesium alloy was placed in the gating system contacting only one supporting surface. The latter has only been conceptually brought forth; it has not been used in a practical manner to date.

This progression of technology has resulted in a more matched use of magnesium or other nodularizing agent with the needs of the specific casting, it has eliminated fading effects associated with the use of the alloy, eliminated flare and other environmental problems, and has aided in reducing costs. Nonetheless, there still remains the likelihood of (a) defects in the casting resulting from undissolved or nonuniformly mixed particulate nodularizing agent which has floated or has been carried into the cavity, (b) variable segregation of the alloy or a variable solubility rate causing a metallurgical variation in the casting, (c) unnecessary waste resulting from expansion of the volume of the gating system to accommodate the particulate matter, (d) the inability to closely target the minimum amount of magnesium to obtain complete or partial nodularization, (e) slag defects in the casting resulting from the greater surface oxidation of the selected nodularizing agent used in particulate form, (f) the inability to remove the alloy from unpoured molds, thus deteriorating the molding properties of the sand mixture in said unpoured molds.

Even if the nodularizing agent was used in a very elemental cast form, prior to its being ground and sized into a particulate or powder form, such cast form would not achieve the objects of this invention because (a) it is not in a condition which will fit the variety of sizes and quantities required of different casting applications without special tailoring a specific such application, (b) the cast form usually is not made and therefore cannot be later converted to an angular form which may be required for a predetermined solution rate, and (c) the cast form generally has not been able to be made in thicknesses greater than 1.25 inches without encountering significant segregation within the interior of the cast form.

SUMMARY OF THE INVENTION

A primary object of this invention is to provide an improved nodularizing catalyst for making spheroidal graphite cast iron.

Another object is to provide nodularization catalysts in a module form so that it may be manually broken into any desired block configuration constituting one or more of said modules and thereby facilitate meeting the needs of a variety of different casting applications without the necessity for tailoring the specific nodularizing agents for each individual application.

Specific features pursuant to the above objects comprise the provision of a solid impervious sheet-like stock having a grid pattern of perforations or notches along at least one side of said stock, said stock being particularly brittle.

Another object of this invention is to provide a nodularizing catalyst comprised principally of an alloy of magnesium, iron and silicon, said alloy being cast preferably in thicknesses from 0.5 to 4 inches without significant segregation interiorly of said as-cast product.

Yet still another object of this invention is to provide an improved method for making nodularizing catalysts, which method facilitates use of the product within the gating system of the mold and yet achieve a substantially constant solution rate according to the desires of the operator.

Another object of this invention is to provide an improved method for making nodularizing agent free from crushing which method facilitates use of the product for the sandwich process, immersion, etc. The invention can also be used to reduce crushing requirements and the generation of undersize material.

DETAILED DESCRIPTION

Figure 1:
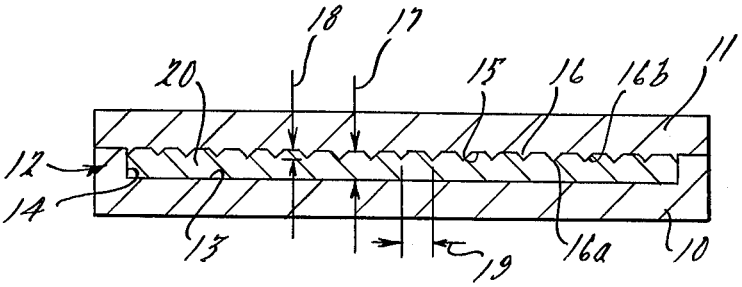
FIG. 1 is a sectional elevational view of a mold useful for producing the nodularizing catalyst of this invention.
Figure 2:
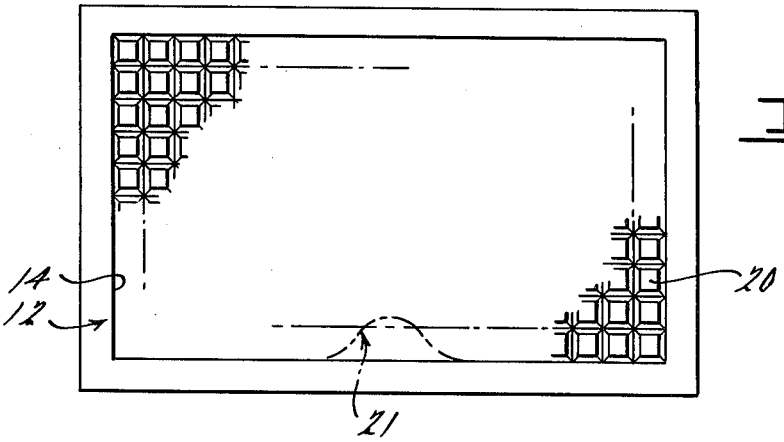
FIG. 2 is a plan view of the mold construction shown in FIG. 1.

As shown in FIGS. 1 and 2, a preferred construction of a mold useful in making a nodularizing catalyst is comprised of a shallow pan-like molding base (drag 10) and a flat cover (cope 11) adapted to fit so as to close off the interior of the pan. The cope and drag are each constituted of metal and have a sufficient thickness to provide a predetermined rate of cooling for the molten catalyst charge to be introduced into the covered mold. The interior 20 of the drag is defined by a generally flat bottom surface 13 and a continuous upright peripheral surface 14. The surface 14 may have a slight taper to accommodate stripping of the mold from the drag, preferably in the range of 3°-8°. The cope has a flat interior surface 15 substantially parallel to the bottom surface 13 of the drag when the cover is in the closed condition, as shown in FIG. 1. The interior surface 15 is interrupted by a plurality of depending ribs 16 which are arranged in a predetermined pattern as best illustrated in FIG. 2. The ribs each have slanted sides 16*b* meeting at an apex 16*a*, the apex penetrates or projects into the interior of the cavity defined by the drag to a distance roughly half the depth defined by the cavity in the closed condition. The projection or penetrating distance 18 of each of the ribs is designed to imprint a perforation or groove line into the resulting cast nodularizing catalyst sheet so that the sheet product may be broken into a desired number of modules constituting said pattern. The module is determined by the spacing between the ribs in either direction of the cast product. The module is preferentially selected to have a dimension which is generally square. The module is designed to accommodate the smallest or minimum casting charge with which the nodularizing catalyst is to be used. As a practical application, the distance 19 between the apices 16*a* of ribs, taken in one direction, is about 2 inches. The thickness of height 17 of the cast product is preferentially in the range of 0.5–4.0 inches, this being considerably greater than the thickness range capable of being cast by the prior art techniques without encountering significant segregation in the interior of the cast product.

A fluid gating means 21 may be provided, such as by defining a mouth in the cover through which a molten charge of the nodularizing catalyst may be poured. The nodularizing catalyst which this invention is concerned, is essentially comprised of a nodularizing element selected from the group consisting of magnesium, cerium, calcium and rare earth metals, said selected element being alloyed with iron and silicon in a homogeneous form substantially devoid of segregation and oxides on the interior thereof. The oxides are substantially eliminated by maintaining the product in the as-cast form since the covered mold system therefore eliminates contact with oxygen during the solidification process and there is no crushing involved.

The as-cast product is thus formed of a solid impervious brittle body comprised of an iron and silicon base alloyed with a suitable element to effect nodularization. Preferably, such width is about 9 feet and the length is approximately 18 feet, whereas the thickness varies preferentially from 0.5–4.0 inches. The as-cast sheet or product has premolded perforations along at least one surface thereof as shown in FIG. 2. In certain applications, the depending ribs may project from both the interior of the cover as well as from the interior of the bottom drag or pan. Thus, the spacing from the apices of opposed ribs will reduce the smallest thickness of the as-cast product. With the ribs defining perforations in both surfaces of the as-cast product, and the ribs also containing slanted sides 16*b*, as shown in FIG. 1, the module (to be manually stripped or broken off from the sheet product) will have tapered upper and lower sides which facilitates control of the solution rate in certain instances where a variable flow rate is encountered during the molding or pouring operation.

When the catalyst is particularly comprised of magnesium ferrosilicon, such molding technique as disclosed herein will provide less than 0.20% impurities within the interior of the as-cast sheet and the magnesium may generally be concentrated in the range of between 5–15%.

Figure 3:
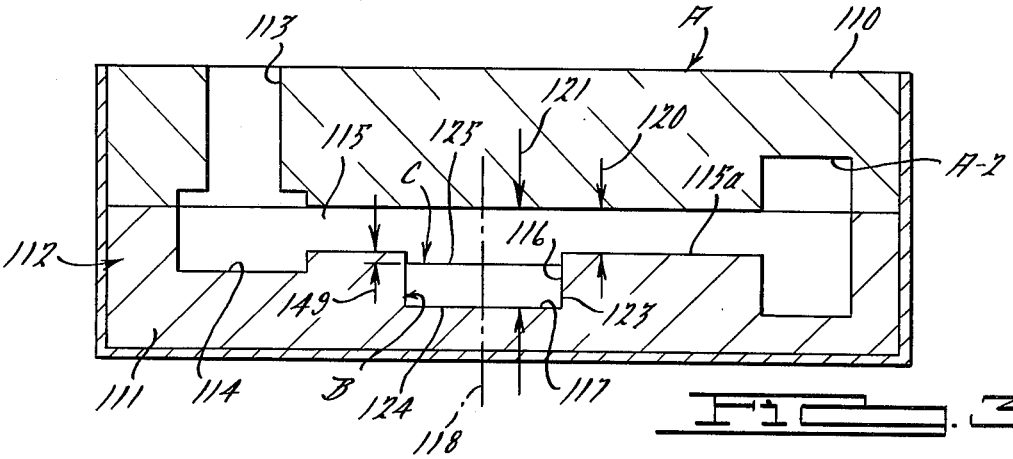
FIG. 3 is a sectional elevational view, substantially schematic for a mold system for making cast iron utilizing a precast nodularizing catalyst of FIGS. 1 and 2.
Figure 4:
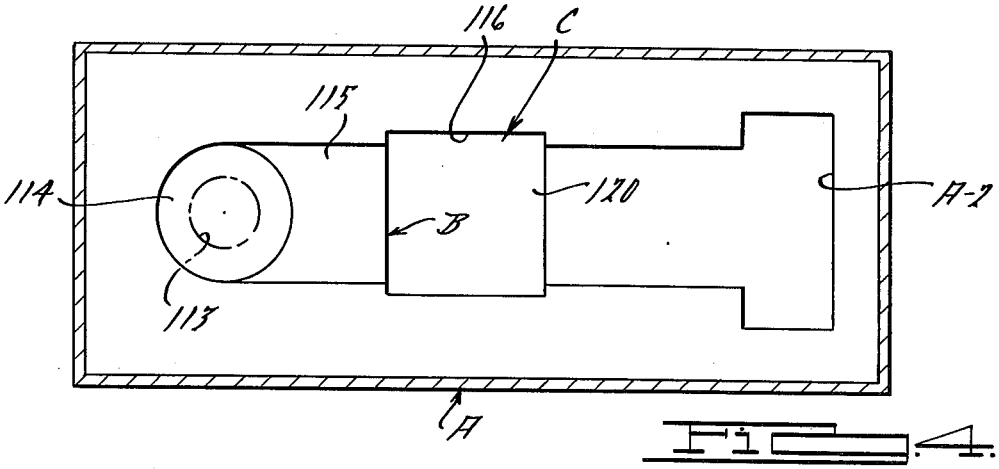
FIG. 4 is a plan view of the mold system of FIG. 3.

As shown in FIGS. 3 and 4, the mold system A comprises particularly a cope 110 and a drag 111 meeting along a parting surface 112 which extends horizontally through first walls defining the cavity A-2. The gating system employs second walls defining a conventional downsprue 113 with a basin 114, the basin having a cross-section greater than the downsprue or horizontal runner 115 (the horizontal runner 115 leads to the molding cavity A-2). The gating system may contain risers, skimmers, dams and other devices which are not shown here.

The recess B has second walls comprised of side walls 116 and bottom wall 117 which define a space set into and along the lower wall 115*a* of the horizontal runner. The cross-sectional area of recess B as viewed generally parallel to surface 115*a* (or transverse to line 118 which is normal to the extent of the surface 115*a*) is substantially the same throughout each elevation of the block. The side walls 116 may be given a slight taper (such as 3–5% which is equivalent to the draft angle of a conventional sand mold) to reduce the cross-sectional area at the bottom of the recess and thus accommodate an increase in dwell time of the trailing end of the charge flow which occurs particularly with gating systems experiencing a large variation in iron flow rate during the entire pour cycle.

In order to achieve minimum 80% nodularity in the casting, the exact volume of recess B must be obtained substantially empirically, but as a rough rule it is designed in conformity with the following relationship:

$$V(\text{in}^3) = (K \times W)/M$$

where $K$ = constant $W$ = weight of the metal poured into the mold $M$ = % Mg in MgFeSi alloy $K = 0.265$ for average casting sections $\frac{1}{4}$ to 1.5 inches;

$= 0.275$ for average casting sections 1.5 to 4 inches

The weight is that of the molten cast iron charge. This relationship is significant since it demonstrates that the reduced volume required with this invention is opposed to that required for the prior art; the volume relationship is typically at least twice as much to accommodate particulate material and maintain an equivalent solution rate with all other factors being equal. In many applications, the block form will occupy about 80% of the volume of the recess wherein the powder form occupies typically a maximum of 55%. The height 120 of the runner 115 can be as little as 0.25 inches, but the height 121 of the recess should be no greater than 10 times the dimension at 120. This dimensional limitation cannot be achieved when using a particulate agent.

The nodularizing agent is formed as an impervious mass or block C snugly fitting into recess B; side walls 123 and bottom wall 124 respectively mate with side walls 116 and bottom wall 117 of the recess. The mating relationship is such that molten cast iron cannot conveniently flow along the sides of the block other than the upper exposed surface 125. Some penetration may be experienced in some applications along the sides of the block due to small tolerance variations, but this quickly freezes during conditioning and the flow avoids this area. The upper surface is configured to be substantially parallel and slightly below the surface 115*a* of the runner (such as 0.25 inches or less inches; with particulate material the distance 149 must be at least 0.75 inches). Thus, molten cast iron will be encouraged to intimately contact surface 125 of the block since it will drop and undergo a dip in its flow across the block; this will prevent molten metal from gliding swiftly in a streamlined manner with large portions thereof never contacting the block. Both because the block is solid and the flow is drawn down to the block out of the normal runner flow, there will be little or no tendency for dragging particles of undissolved agent into the casting cavity. The agent will not move until reacted with the flow; this is also assured by reducing 5–10% the cross-sectional area of the runner exiting from the recess in comparison to the cross-sectional area of the runner leading to the recess.

The block is preferably constituted of magnesium ferrosilicon alloy such as is conventionally used in the production of nodular iron, but other agents may be selected from the group consisting of cerium, yttrium, other rare earths, calcium, and their alloys and such selected agent may be combined in a desired concentration with other elements compatible with cast iron to form a binary or more complex conditioning alloy. Examples of other elements are iron, silicon, carbon, nickel, etc.

The nodularizing agent is preferably formed as a substantially homogeneous substance such as by casting into chill molds. For making magnesium ferrosilicon, a quantity of quartzite (silica) is reduced and melted in the presence of carbon and iron to a molten ferrosilicon alloy in an electric furnace, to which is added magnesium (5–15%) and generally rare earth metals and calcium. The molten nodularizing alloy is poured into closed chill molds to define modules or precisely measured blocks with predetermined dimensions. The interior of each block will be substantially free of oxides; and will generally have far less total MgO/pound of alloy as a result of far less surface area per pound than particulate alloy forms. This is important because one of the advantages herein is an increase in solution rate and greater economy of alloy use due to more free magnesium available within the alloy. Thus, less contact time of the molten charge is required to pick up the required amount of magnesium to facilitate nodularization. One possible explanation for this is concerned with a physical barrier. If MgO were present, such as about each particle of a powdered agent (whether in loose or compacted form), this MgO does not take part in the nodularization of cast iron but contaminates the iron charge as a slag or dross impurity. This is generally prevented from entering the casting cavity by enlarging the runner and the gating volume so as to allow it to float out of the metal. Another possible explanation for this may be grounded in heat transfer. The heat of the molten cast iron must first be used to remove the outer shell of refractory-like oxide before heat can operate on the agent itself. This increase in heat will require that the molten runner flow be 2–3 inches higher for a typical casting application and will limit mold design, reduce casting yield, and increase the possibility of a non-uniform nodularized casting. Variations in surface oxidation during crushing, handling and storage of particulate nodularizing alloy forms increase this problem. With these two factors, the total volume of the runner or gating system can now be made smaller; the risers, downsprues, and runners can be reduced as much as 25% in some cases (the recess or reaction chamber can be reduced by as much as 60%), thus rendering a significant increase in yield.

The block, since it is made as a direct chill casting has minimum alloy segregation and results in a uniformly conditioned molten iron. Alloy segregation may occur in two ways with respect to powdered agents: (a) when made as a powder, such as 6 × 20 mesh, the finer particles will settle out toward the bottom of the bulk shipment during transportation to the site of use; (b) all finer particles will, immediately on crushing, form an MgO coating which is an impurity and may constitute a significant volume of the powder. The latter shows up as slag in the system and, if excessive, will move to the final casting as a defect. Only by reducing the exposed surface area of the agent can this be improved.

The solid character of the agent is advantageous also because it allows a consistently accurate predetermined weight of agent, free from operator discretion or errors of calculation. The block eliminates migration of the agent into the casting cavity in an undissolved form; the latter may occur with a powdered or granular agent as drag-through by the molten metal flow (see FIG. 3) or as blow-out (or off) when the open drag is cleaned off by air jets prior to mold closure while the agent is in place. With respect to the latter, high air flows can now be used during the blow-off step without risk of contamination or loss of agent. Moreover, the typical alloy addition operation can now be manually handled by one or two men as opposed to two or three men using the techniques of the prior art. Automation of the addition system is also considerably simplified with the block material.

The design of the cross-sectional area of the block is critical to achieving a uniform solution rate, the latter being unattainable by the prior art. The cross-sectional area determines the exposed interface with the molten cast iron since the sides and bottom and interior of the block are not exposed to molten iron flow. Thus, as the each successive section of the block dissolves, a new cross-section becomes progressively exposed. This interface area should be substantially constant throughout the entire period of conditioning, although it has been found necessary to deviate somewhat when using a casting technique experiencing a wide variation in ferrostatic pressure head and consequently molten iron flow rate over the block during conditioning. The former can be achieved by making the block with a uniform cross-section throughout, the latter can be achieved by incorporating a taper into the side walls of the block so that the bottom cross-sectional area will be less. The taper can be about 5°–15°. A wide variation of ferrostatic pressure will occur in vertical shell mold casting techniques where a tall object is to be cast. The weight of the molten iron in the filling cavity will counter the weight of the iron in gating system causing a decrease in pour rate near the trailing end of conditioning which in turn increases the molten iron dwell time and thus the amount of heat being transferred to the agent in the recess. By slightly reducing the exposed interface area at the trailing end of the pour commensurate with the change in molten iron flow rate, a constant solution rate can be assured.

Although the block is preferably illustrated in FIGS. 3 and 4 as recessed in a wall of the horizontal runner with a mold system, it can be recessed in a wall of runner system used as an exterior stream treatment device for conditioning the molten iron prior to it being introduced to the mold.

We claim as our invention:

1. A nodularizing agent in unitary discrete form suitable for placement in an interior recess of a mold gating system, said agent having a solid impervious brittle body consisting essentially of an iron-silicon base alloyed with 5–15% by weight of nodularizing elements effective to cause the formation of spheroidal graphite during solidification of cast iron, said body having substantially flat side and bottom walls to mate snugly with said mold gating system for the substantial exclusion of molten metal therebetween.

2. The agent as in claim 1, in which the thickness of said sheet is in the range of 0.5–4.0 inches while being devoid of segregation or oxides within the interior thereof.

3. The agent as in claim 1, which is essentially constituted of magnesium ferrosilicon having less than 0.2% impurities and containing between 5–15% magnesium.

4. A nodularizing agent in sheet form having a thickness in the range of 0.5 – 4.0 inches and having a grid pattern of V-shaped perforations arranged throughout both upper and lower surfaces of said sheet, said V-shaped perforations penetrating said sheet thickness to define fracture planes no less than 40% of the thickness of said sheet, said sheet form having a solid impervious brittle body consisting essentially of an iron-silicon base alloyed with 5–15% by weight of nodularizing elements selected from the group consisting of magnesium, cerium, calcium and rare earth metals, said nodularizing elements being effective to cause the formation of spheroidal graphite during solidification of cast iron, said sheet form being severable into discrete blocks along said fracture planes whereby said block may be employed as premeasured additives to be placed into an interior recess of a mold gating system previously preformed to snugly accept said block.

* * * * *